US006386665B2

(12) United States Patent
Takahashi et al.

(10) Patent No.: US 6,386,665 B2
(45) Date of Patent: May 14, 2002

(54) INK-JET RECORDING APPARATUS

(75) Inventors: Yoshikazu Takahashi; Koichiro Hara, both of Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/854,507

(22) Filed: May 15, 2001

Related U.S. Application Data

(63) Continuation-in-part of application No. 09/841,830, filed on Apr. 26, 2001, now Pat. No. 6,257,686, and application No. 09/841,997, filed on Apr. 26, 2001.

(30) Foreign Application Priority Data

May 17, 2000 (JP) ..... 2000-144665

(51) Int. Cl.[7] ..... B41J 29/38
(52) U.S. Cl. ..... 347/10; 347/11
(58) Field of Search ..... 347/9–11, 68, 347/69

(56) References Cited

U.S. PATENT DOCUMENTS 4,879,568 A 11/1989 Bartky et al. ..... 347/69
4,887,100 A 12/1989 Michaelis et al. ..... 347/69
5,028,936 A 7/1991 Bartky et al. ..... 347/69

FOREIGN PATENT DOCUMENTS

JP 403222750 A * 10/1991 ..... 347/10
JP 405155010 A * 6/1993 ..... 347/11

* cited by examiner

*Primary Examiner*—John Barlow
*Assistant Examiner*—An H. Do
(74) *Attorney, Agent, or Firm*—Oliff & Berridge, PLC

(57) ABSTRACT

An ink jet recording apparatus wherein each dot, having the same size, may be formed regardless of whether print commands are successive. The ink jet recording apparatus includes a first drive waveform and a second drive waveform wherein the second drive waveform is used when there is no dot printed immediately before a dot is to be printed and the first drive waveform is used when there is a dot printed in response to a print command immediately before a dot is to be printed. Thus, regardless of whether the first drive waveform or the second drive waveform is used, the same volume of ink droplets are ejected and the same sized dots are formed.

30 Claims, 9 Drawing Sheets

| IMMEDIATELY BEFORE | DRIVE WAVEFORM |
| --- | --- |
| EJECTED | DRIVE WAVEFORM 1 |
| NOT EJECTED | DRIVE WAVEFORM 1 |

FIG. 2(a)

| IMMEDIATELY BEFORE | DRIVE WAVEFORM |
| --- | --- |
| EJECTED | DRIVE WAVEFORM 1 |
| NOT EJECTED | DRIVE WAVEFORM 2 |

FIG. 2(b)

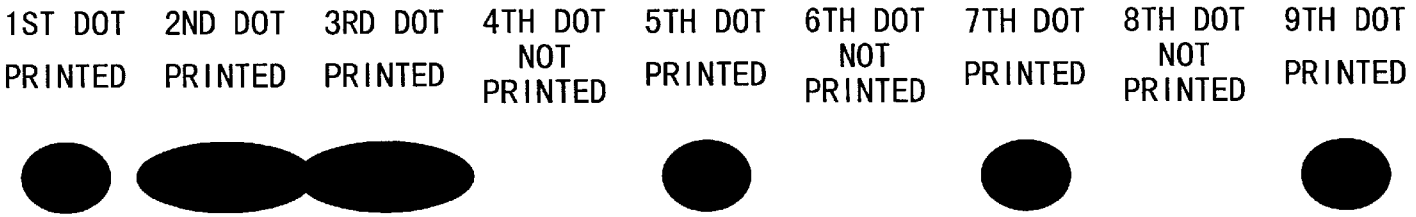
FIG. 3(a)
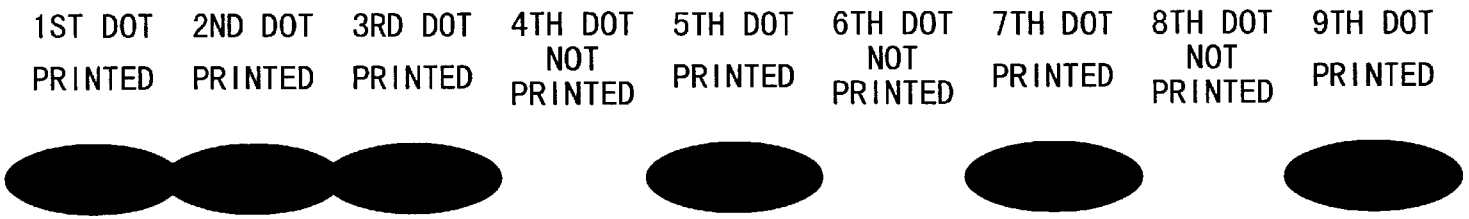
FIG. 3(b)
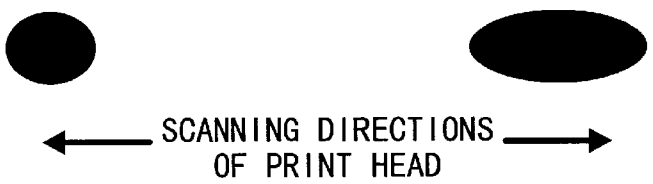
FIG. 4(a)
FIG. 4(b)

INK-JET RECORDING APPARATUS

This application is a Continuation-In-Part application of U.S. Pat. No. 6,257,686, application Ser. No. 09/841,830 filed on Apr. 26, 2001 and application Ser. No. 09/841,997 filed on Apr. 26, 2001, the disclosures of which are incorporated by reference herein.

BACKGROUND OF THE INVENTION

1. Field of Invention

The invention relates to an ink-jet recording apparatus.

2. Description of Related Art

An ink-jet recording apparatus includes a shear mode type ink-jet print head formed of piezoelectric material, as disclosed in U.S. Pat. Nos. 4,879,568, 4,887,100, and 5,028,936. In such an ink-jet print head, application of a voltage to the piezoelectric material causes the volumetric capacity of an ink channel to be changed. When the volumetric capacity is reduced, pressures are applied to ink in the ink channel, thereby ejecting an ink droplet from a nozzle. The ejected ink droplets impinge against a recording medium, forming text or graphics thereon.

SUMMARY OF THE INVENTION

Ink droplet volume for one dot may be easily controlled by ejecting a plurality of ink droplets for one dot. Because print density of a dot may be adjusted by changing the ink droplet volume, contrast and gradation may precisely be reproduced, improving print quality.

In the invention, drive pulse waveforms used for forming a dot with a plurality of ink droplets are changed according to whether there is an immediately preceding dot when forming a dot. Thus, the plurality of ink droplets forming a single dot may be individually ejected, without merging the ink droplets during flight.

Each of the ink droplets, flying separately, impinge against the recording medium and are slightly shifted with the relative movement of an ink-jet print head and the recording medium. Consequently, the area of a thus formed dot may be enlarged. By the above-described method, the print density may be controlled, as well as gradation may be precisely represented, by changing the number of ink droplets to be ejected.

In recent years, the need for high-speed printing and high-density printing have increased. For the high-speed printing, printing frequencies need to be raised. When the printing frequencies are raised, ink droplet ejection cycles become shortened. Therefore, after an ink droplet is ejected, vibrations remaining in the ink in an ink channel may influence the ejection of a next ink droplet. Such influences of the vibrations on the next ink droplet ejection becomes significant when the number of ink droplets to be ejected for one dot needs to be increased for the high-density printing.

The application of an invention wherein the print density is controlled as described above, may be effective to obtain a high-quality output of an image when high-speed and high-density printing is executed.

In the invention, a plurality of drive waveforms are stored in a memory. The drive waveforms are selected according to whether a first dot is printed immediately before a second dot is printed. The drive waveforms stored in the memory are different from each other. Furthermore, plurality of ink droplets are ejected to form one dot. When printing is performed based on the selected drive waveforms, each of the plurality of ink droplets, individually and sequentially, impinge against the recording medium. The ink droplets impinge against the recording medium at positions slightly shifted from each other because the print head that ejects ink droplets moves relative to the recording medium.

When a dot is formed by a plurality of ink droplets, each of which individually impinges against the recording medium, the ink droplets have a larger area than a dot formed by ink droplets merging during flight and impinging against the recording medium. Thus, areas dense with ink become large. Further, in the invention, a gap between adjacent dots is not formed, leading to the improved quality.

In the invention, regardless of whether any of the drive waveforms are used for printing, the volumes of the ink droplets ejected for one dot are the same and the shapes of the dots formed on the recording medium are the same.

Each of the drive waveforms includes a plurality of ejection pulses for the ejection of a plurality of ink droplets. Ink in an ink channel vibrates after an ink droplet is ejected. The vibrations remaining in the ink channels may have an adverse effect on the ejection of a next ink droplet. To reduce the adverse effect on the ejection of ink droplets, a stabilizing pulse to suppress the residual vibrations may be provided following the ejection pulse. The stabilizing pulse does not contribute to eject the ink, but serves to suppress the vibrations in the ink. With the stabilizing pulse, an ink droplet is stably ejected from a nozzle after the ejection of an ink droplet.

The widths of the ejection pulse and the stabilizing pulses and the intervals between the pulses may be arranged without restraint, according to the types and the viscosity of ink to be used, ambient temperatures, distances between a nozzle and a recording medium, and other conditions.

BRIEF DESCRIPTION OF THE DRAWINGS

An exemplary embodiment of the invention will be described in detail with reference to the following figures wherein:

FIGS. 2(*a*) and 2(*b*) are tables showing conditions for selecting the drive waveforms;

FIGS. 3(*a*) and 3(*b*) are schematic illustrations of dots printed using the drive waveforms;

FIGS. 4(*a*) and 4(*b*) illustrate differences in diameters of dots, according to differences in flight conditions of ink droplets;

DETAILED DESCRIPTION OF PREFERRED EMBODIMENTS

An exemplary embodiment of the invention will be described in detail with reference to the figures.

Figure 9:
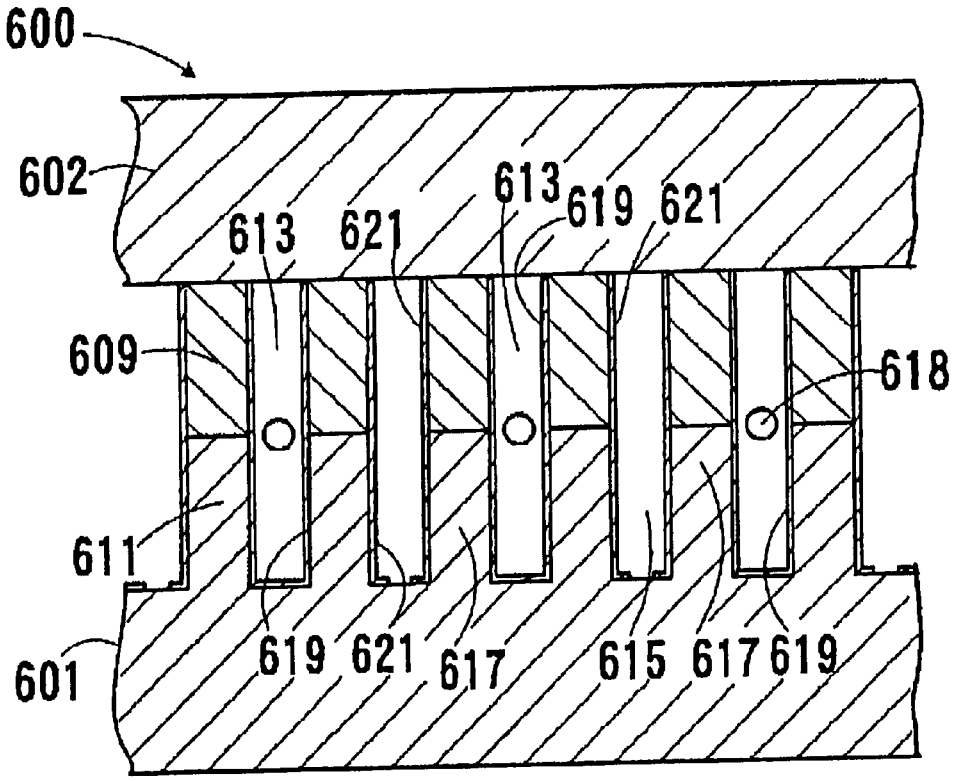
FIG. 9 is a sectional view of an ink-jet head of the ink-jet apparatus.
Figure 10:
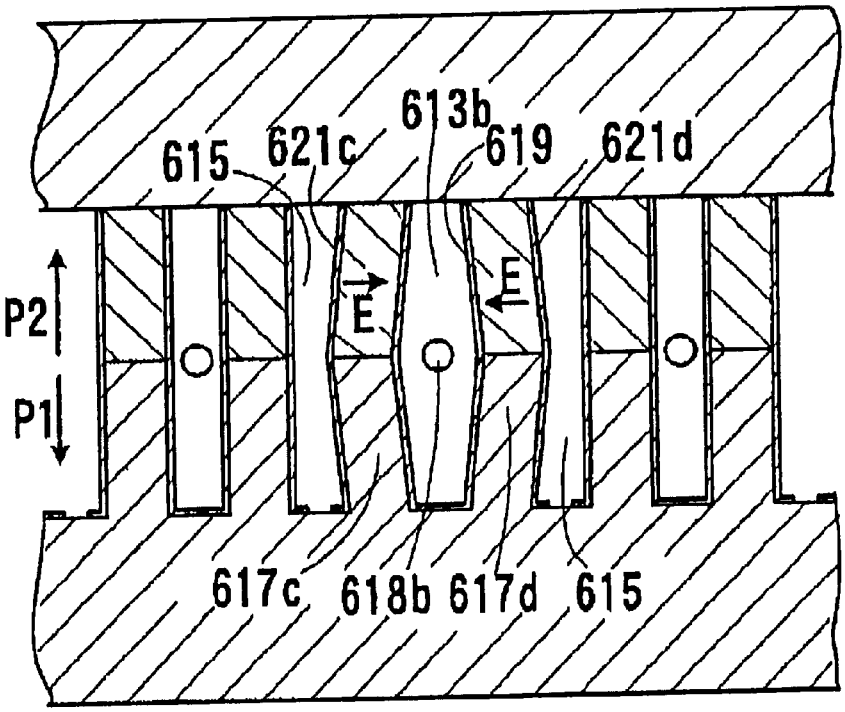
FIG. 10 illustrates actions of the ink-jet head shown in FIG. 9.
Figure 11:
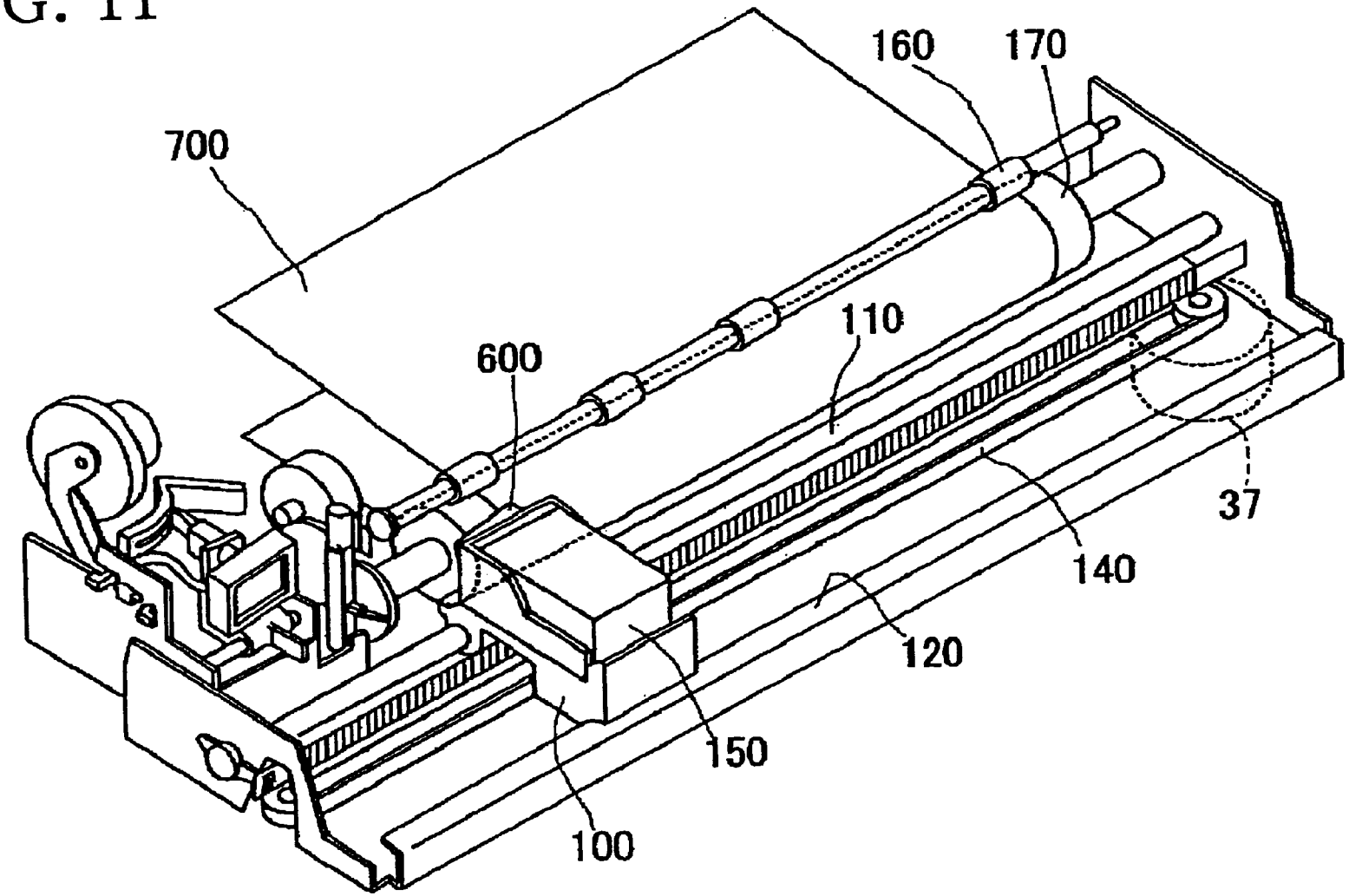
FIG. 11 is a perspective view of the ink-jet recording apparatus.

Referring to FIGS. 9, 10, and 11, the structure of an ink-jet recording apparatus and the structure of a head unit will be described.

As shown in FIG. 11, an ink-jet head unit 600 is mounted on a carriage 100 and scans in parallel with a recording medium 700. The carriage 100 is slidably supported by guide bars 110, 120. The carriage 100 is also fixed to a belt 140 extending in parallel with the guide bars 110, 120. The belt 140 is moved by a driving force of a motor 37. As the belt 140 is moved, the carriage 100 reciprocates along the guide bars 110, 120. A tank 150, in which ink is stored to be supplied to the head unit 600, is removably attached to the carriage 100. The recording medium 700 is held by feed rollers 160, 170 to be parallel with the scanning directions of the head unit 600 and is fed perpendicularly to the scanning directions.

FIG. 9 is a cross-sectional view of the head unit 600.

The head unit 600 includes an actuator substrate 601 and a cover plate 602. Formed in the actuator substrate 601 are a plurality of ink channels 613, each shaped like a narrow groove and extending in the thickness direction of the sheet of FIG. 9, and a plurality of dummy channels 615 carrying no ink. Each ink channel 613 and each dummy channel 615 are isolated by an interposed sidewall 617. Each sidewall 617 is divided into a lower wall 611 and an upper wall 609, which are polarized in opposite directions P1 and P2, respectively along the height direction of the sidewall 617. A nozzle 618 is provided at one end of each ink channel 613, and a manifold (not shown) for supplying ink is provided at the other end thereof. Each dummy channel 615 is closed at the manifold-side end to block the entry of ink. Electrodes 619, 621 are provided, as metalized layers, on opposite side surfaces of each sidewall 617. More specifically, an electrode 619 is disposed along the sidewall surfaces facing the ink channel 613, and all electrodes 619 provided in the ink channels 613 are grounded. A dummy channel electrode 621 is disposed on the sidewall surface on either side of the dummy channel 615. Opposed electrodes 621 in the dummy channel 615 are insulated from each other and separately connected to a controller for producing drive signals.

Upon application of a voltage on two dummy channel electrodes 621, disposed across the interposed ink channel 613, the sidewalls 617 with the dummy channel electrodes 621 are deformed, by a piezoelectric shearing effect, in such directions that the volumetric capacity of the interposed ink channel 613 is increased.

As shown in FIG. 10, to change the volumetric capacity of an ink channel 613*b*, a voltage of E V is applied to electrodes 621*c*, 621*d*, disposed respectively on the sidewalls 617*c*, 617*d*, which define the ink channel 613*b*. The voltage of E V is applied to electrodes 621*c*, 621*d*, with all electrodes 619 grounded. Consequently, electric fields are generated on the sidewalls 617*c*, 617*d* in the directions of arrows E, which are perpendicular to their polarized directions. Then, the upper and lower walls of the sidewalls 617*c*, 671*d* are deformed, by a piezoelectric shearing effect, in such directions that the volumetric capacity of the ink channel 613*b* is increased. At this time, the pressure in the ink channel 613*b*, including in the vicinity of the nozzle 618*b*, is reduced. By maintaining such a state for a period of time T required for one-way propagation of a pressure wave along the ink channel 613*b*, ink is supplied from the tank 150 (FIG. 11), though the manifold (not shown), to the ink channel 613*b*.

The one-way propagation time T represents a time required for a pressure wave in the ink channel 613*b* to propagate longitudinally along the ink channel 613*b*, and is given by an expression T=L/c, where L is a length of the ink channel 613*b*, and c is a speed of sound in the ink in the ink channel 613*b*. According to the theory of propagation of a pressure wave, when the time T has elapsed from the application of a voltage, the pressure in the ink channel 613*b* is reversed to a positive pressure. The voltage applied to the electrodes 621*c*, 621*d* is reset to 0 V concurrently with the reversing of the pressure.

Then, the sidewalls 617*c*, 617*d* return to their original states (FIG. 9), and pressurize the ink in the ink channel 613*b*. At this time, the pressure reversed to a positive pressure is combined with the pressure generated upon returning of the sidewalls 617*c*, 617*d*, and a relatively high pressure is generated in the vicinity of the nozzle 618*b* provided on one side of the ink channel 613*b*. As a result, an ink droplet is ejected from the nozzle 618*b*.

If a time period between applying a voltage of E V and resetting the voltage to 0 V does not equal to the one-way propagation time T, energy efficiency for ink ejection decreases. Particularly, when the time period between applying and resetting the voltage is even multiples of the one-way pressure wave propagation time T, no ink is ejected. When high energy efficiency is desired, that is, when driving at a voltage as low as possible is desired, it is preferable that the time period between applying and resetting the voltage is equal to the one-way pressure wave propagation time T, or approximately odd multiples of the time T.

Specific dimensions of the head unit 600 will be described by way of example. The ink channel 613 is 6.0 mm in length (L). The nozzle 618 is tapered and is 26 $\mu$m in diameter on the ink ejecting side, 40 $\mu$m in diameter on the ink channel side, and 75 $\mu$m in length. When the temperature is 25° C., the viscosity of the ink used is approximately 2 mPa-s and the surface tension thereof is 30 mN/m. The ratio L/c (=T) of the sound speed c in the ink in the ink channel 613 to the length L of the ink channel 613 is 9.0 $\mu$sec.

Figure 1A:
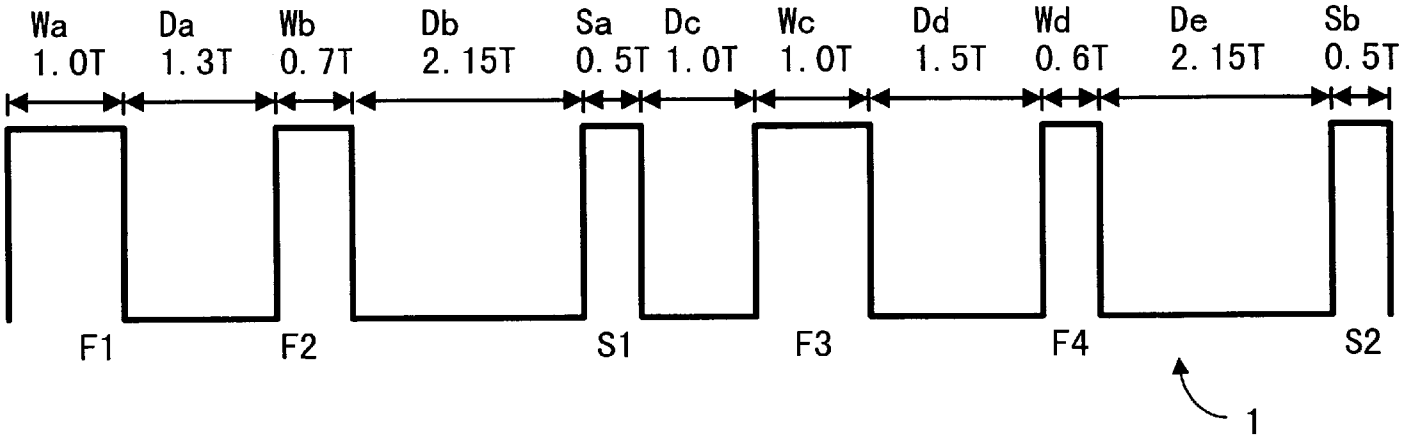
FIGS. 1(*a*) and 1(*b*) illustrate drive waveforms for driving an ink-jet apparatus to eject ink droplets, according to an exemplary embodiment of the invention.
Figure 1B:
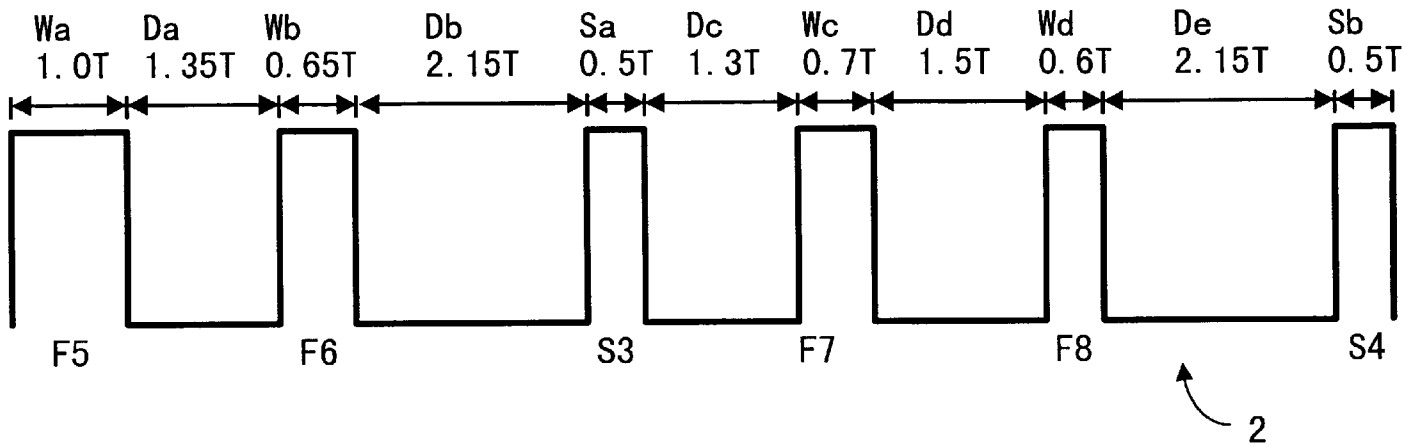

FIGS. 1(*a*) and 1(*b*) show drive waveforms for driving the ink-jet apparatus to eject four ink droplets in response to a dot print command.

FIG. 1(*a*) shows a drive waveform 1 used for printing at high frequencies. The drive waveform 1 is used when dots, each of which are formed of four ink droplets, are successively printed. FIG. 1(*b*) shows a drive waveform 2 used for printing at substantially low frequencies. The drive waveform 2 is used when a dot, formed of four ink droplets, is printed at frequencies equal to or lower than ½ (half) the printing frequencies used for the drive waveform 1. That is, dots are printed intermittently at the frequencies of printing used for the drive waveform 1.

Each numeric value added to each of the pulses shown in FIGS. 1(*a*) and 1(*b*) indicates a length of time in relation to the one-way propagation time T of a pressure wave in the ink channel 613.

The drive waveform 1 shown in FIG. 1(*a*) includes ejection pulses F1, F2, F3, and F4 for ejecting four ink droplets, and two stabilizing pulses S1 and S2 for reducing residual pressure wave vibrations in the ink channel 613. After the ejection pulses F1 and F2, the stabilizing pulse S1 is applied. Then, another stabilizing pulse S2 is applied after the ejection pulses F3 and F4.

After an ink droplet is ejected with the ejection pulse applied immediately before the stabilizing pulse, the residual pressure is increased in the ink channel 613. At the leading edge of the stabilizing pulse, the volumetric capacity of the ink channel 613 is increased, so that the residual pressure therein is reduced. When the residual pressure in the ink channel 613 is decreased, the volumetric capacity of the ink channel 613 is reduced to return to the original state at the trailing edge of the stabilizing pulse. Thus, the residual pressure wave vibrations in the ink channel 613 is almost cancelled and reduced. The stabilizing pulses S1, S2 are applied to suppress the residual pressure wave vibrations in the ink channel 613, and do not serve to eject ink droplets.

Crest values (that is, voltage values) of all the ejection pulses and the stabilizing pulses are E V, for example, 16 V at an ambient temperature of 25° C. The width Wa of the ejection pulse F1 equals 1.0 times the one-way propagation time T of a pressure wave in the ink channel 613, that is, 9.0 μsec. The width Wb of the ejection pulse F2 equals 0.7 times the one-way propagation time T, that is, 6.3 μsec. The time interval Da between the ejection pulses F1 and F2 equals 1.3 times the one-way propagation time T, that is, 11.7 μsec. The width Sa of the stabilizing pulse S1 equals 0.5 times the one-way pressure wave propagation time T, that is, 4.5 μsec. The time interval Db between the stabilizing pulse S1 and the ejection pulse F2 equals 2.15 times the one-way pressure wave propagation time T, that is, 19.35 μsec. The time interval Dc between the stabilizing pulse S1 and the ejection pulse F3 equals 1.0 times the one-way pressure wave propagation time T, that is, 9.0 μsec.

The width Wc of the ejection pulse F3 equals 1.0 times the one-way propagation time T, that is, 9.0 μsec. The width Wd of the ejection pulse F4 equals 0.6 times the one-way propagation time T, that is, 5.4 μsec. The time interval Dd between the ejection pulses F3 and F4 equals 1.5 times the one-way pressure wave propagation time T, that is, 13.5 μsec. The width Sb of the stabilizing pulse S2 equals 0.5 times the one-way pressure wave propagation time T, that is, 4.5 μsec. The time interval De between the stabilizing pulse S2 and the ejection pulse F4 equals 2.15 times the one-way pressure wave propagation time T, that is, 19.35 μsec.

When a voltage is applied to the electrodes 621 according to the drive waveform 1, two ink droplets are successively ejected by the application of the ejection pulses F1, F2. Then, the stabilizing pulse S1 is applied to suppress the residual pressure wave vibrations in the ink channel 613. After that, two ink droplets are successively ejected with the application of the ejection pulses F3, F4, and then the stabilizing pulse S2 is applied to suppress the vibrations in the ink. Thus, four ink droplets are ejected in response to a dot print command. The dot contains approximately 60 pl of ink droplets, which corresponds to the amount of ink droplets required for printing at the resolution of approximately 300 dpi×300 dpi. When dots, each of which are formed of four ink droplets, are successively printed at frequencies from 5 to 8.5 kHz, the ejected ink droplets individually impinge against the recording medium 700. Since each of the four ink droplets are ejected to form one dot by sequentially and individually impinging against the recording medium 700, a dot having an oval shape elongated in the scanning directions of the head unit 600 is formed on the recording medium 700, as shown in FIG. 4(*b*).

FIG. 4(*a*) shows a dot formed when four ink droplets individually ejected merges during flight before impinging against the recording medium 700. When compared with the dot shown in FIG. 4(*b*), the dot shown in FIG. 4(*a*) is greatly different, with respect to the area, even though the both dots are formed by the same volume of the ink droplets.

The drive waveform 2 shown in FIG. 1(*b*) includes ejection pulses F5, F6, F7, and F8 for ejecting four ink droplets, and two non-ink ejection stabilizing pulses S3 and S4 for reducing residual pressure wave vibrations in the ink channel 613. The ejection pulses and the stabilizing pulses of the drive waveform 2 are similar to the ejection pulses and the stabilizing pulses of the drive waveform 1. When a voltage is applied to the electrodes 621 according to the drive waveform 2, two ink droplets are successively ejected by the application of the ejection pulses F5, F6. Then, the stabilizing pulse S3 is applied to suppress the residual pressure wave vibrations in the ink channel 613. After that, two ink droplets are successively ejected with the application of the ejection pulses F7, F8, and then the stabilizing pulse S4 is applied to suppress the vibrations in the ink.

Crest values (that is, voltage values) of all the ejection pulses and the stabilizing pulses are E V, for example, 16 V at an ambient temperature of 25° C.

The width Wa of the ejection pulse F5 equals 1.0 times the one-way propagation time T, that is, 9.0 μsec. The width Wb of the ejection pulse F6 equals 0.65 times the one-way propagation time T, that is, 5.85 μsec. The time interval Da between the ejection pulses F5 and F6 equals 1.35 times the one-way propagation time T, that is, 12.15 μsec. The width Sa of the stabilizing pulse S3 equals 0.5 times the one-way pressure wave propagation time T, that is, 4.5 μsec. The time interval Db between the stabilizing pulse S3 and the ejection pulse F6 equals 2.15 times the one-way pressure wave propagation time T, that is, 19.35 μsec. The time interval Dc between the stabilizing pulse S3 and the ejection pulse F7 equals 1.3 times the one-way pressure wave propagation time T, that is, 11.7 μsec.

The width Wc of the ejection pulse F7 equals 0.7 times the one-way propagation time T, that is, 6.3 μsec. The width Wd of the ejection pulse F8 equals 0.6 times the one-way propagation time T, that is, 5.4 μsec. The time interval Dd between the ejection pulses F7 and F8 equals 1.5 times the one-way pressure wave propagation time T, that is, 13.5 μsec. The width Sb of the stabilizing pulse S4 equals 0.5 times the one-way pressure wave propagation time T, that is, 4.5 μsec. The time interval De between the stabilizing pulse S4 and the ejection pulse F8 equals 2.15 times the one-way pressure wave propagation time T, that is, 19.35 μsec.

As described above, the drive waveform 2 is used for printing at low frequencies. More specifically, the drive waveform 2 is used for printing at the frequencies from 2.5 to 4.25 kHz, which is lower than the printing frequencies of 5 to 8.5 kHz using the drive waveform 1. Printing at the frequencies from 2.5 to 4.25 kHz, corresponds to printing dots at intervals of one dot when frequencies of the print clock signals are 5 to 8.5 kHz in the ink-jet recording apparatus.

When a voltage is applied to the electrodes 621 according to the drive waveform 2, two ink droplets are successively ejected by the application of the ejection pulses F5, F6. Then, the stabilizing pulse S3 is applied to suppress the residual pressure wave vibrations in the ink channel 613. After that, two ink droplets are successively ejected with the application of the ejection pulses F7, F8 and then the stabilizing pulse S4 is applied to suppress the vibrations in the ink. Four ink droplets are ejected in total in response to a dot print command. The dot contains approximately 60 pl of ink droplets, similar to the dot printed using the drive waveform 1. The volume, 60 pl of ink droplets corresponds to the amount of ink droplets required for printing at the resolution of approximately 300 dpi×300 dpi.

When printing is performed at the frequencies of 2.5 to 4.25 kHz by successively ejecting four ink droplets to form one dot, each of the four ejected ink droplets individually impinges against the recording medium 700. Because each ejected ink droplet sequentially and individually impinges against the recording medium 700, the dot having an oval shape elongated in the scanning directions, is formed by four ink droplets on the recording medium 700, as shown in FIG. 4(*b*).

The table below shows the ratio of widths of each ejection pulse and stabilizing pulse, time intervals between the ejection pulses, and time intervals between the ejection pulse and the stabilizing pulse of the drive waveforms 1 and 2, to the one-way pressure wave propagation time T.

| | Wa/T | Da/T | Wb/T | Db/T | Sa/T | Dc/T | Wc/T | Dd/T | Wd/T | De/T | Sb/T |
|---|---|---|---|---|---|---|---|---|---|---|---|
| Drive waveform 1 | 1.00 | 1.30 | 0.70 | 2.15 | 0.50 | 1.00 | 1.00 | 1.50 | 0.60 | 2.15 | 0.50 |
| Drive waveform 2 | 1.00 | 1.35 | 0.65 | 2.15 | 0.50 | 1.30 | 0.70 | 1.50 | 0.60 | 2.15 | 0.50 |

In the drive waveforms 1 and 2, the ejection pulses and the stabilizing pulses are applied in the same manner (in the same order), as described above. However, there are some differences between the drive waveforms 1 and 2 with respect to the widths of the ejection pulses, the time intervals between the ejection pulses, and the time intervals between the stabilizing pulse and the ejection pulse. More specifically, the time interval Da between the first ejection pulse F1 and the second ejection pulse F2 of the drive waveform 1 is different from the time interval Da between the first ejection pulse F5 and the second ejection pulse F6 of the drive waveform 2. The width Wb of the second ejection pulse F2 of the drive waveform 1 is also different from the width Wb of the second ejection pulse F6 of the drive waveform 2. The time interval Dc between the first stabilizing pulse S1 and the third ejection pulse F3 of the drive waveform 1 is different from the time interval Dc between the first stabilizing pulse S3 and the third ejection pulse F7 of the drive waveform 2. Further, the width Wc of the third ejection pulse F3 of the drive waveform 1 is different from the width Wc of the third ejection pulse F7 of the drive waveform 2.

The sum of the widths of the ejection pulses F1–F4 in the drive waveform 1 is 3.3 T. The sum of the widths of the ejection pulses F5–F8 in the drive waveform 2 is 2.95 T. The sums of the widths of the ejection pulses in the drive waveforms 1 and 2 are thus different. However, the time periods from the start to the end of the drive waveforms 1 and 2 are both 12.4 T.

Even when a pulse width or an interval between pulses, which is a factor to determine the shape of the waveform, is changed and different between the drive waveforms 1 and 2, a dot having a larger area, such as shown in FIG. 4(*b*), is formed, if printing frequencies when a drive waveform is used are appropriate. In other words, by using the drive waveform 1 for printing at high frequencies from 5 to 8.5 kHz and using the drive waveform 2 for printing at low frequencies from 2.5 to 4.25 kHz, a dot having a larger area, such as shown in FIG. 4(*b*), can be printed.

Upon experimentation, stable splash-free ink ejection was ensured when dots were printed at temperatures between 5 and 45° C., if the deviation of the width of each ejection pulse and stabilizing pulse, the time intervals between the ejection pulses, and the time intervals between the stabilizing pulse and the ejection pulse, in the drive waveforms 1 and 2, falls within the range of +0.05 to −0.05 times the one-way pressure wave propagation time T.

FIGS. 2(*a*) and 2(*b*) are tables showing the conditions for selecting the drive waveform 1 or 2 to be used for the application of a voltage to the electrodes 621. The use of either the drive waveform 1 or 2 is determined using the tables, according to whether there is an ink ejection command for an immediately preceding dot when a dot is to be printed, that is, there is a dot immediately before a dot to be printed.

FIG. 2(*a*) shows a driving method in which the drive waveform 1 is used to eject four ink droplets to form one dot, regardless of whether there is a dot immediately before a dot to be printed. Results of printing using the driving method shown in FIG. 2(*a*) are presented in FIG. 3(*a*). When dots are successively formed in response to successive print commands, for example, as a second dot and a third dot are successively formed in FIG. 3(*a*), the dots formed on the recording medium 700 have larger areas. However, dots formed on the recording medium 700 have smaller areas when dots are formed apart from their immediately preceding dot in response to discontinuous print commands, for example, as a first, fifth, seventh, and ninth dots are formed apart from an immediately preceding dot. The above-described phenomena regarding the dot formation were found by an experiment and the smaller dots were formed due to the merging of the ejected ink droplets during flight.

A phenomenon such that the ejected ink droplets merged during flight was also observed when dots were successively printed using the drive waveform 2.

FIG. 2(*b*) shows a driving method in which the drive waveform 1 is used when a dot is printed, in response to a dot print command, immediately before a dot to be printed, and the drive waveform 2 is used to eject four ink droplets for one dot when there is no immediately preceding dot. As described above, printing frequencies using the drive waveform 2 correspond to ½ (half) of the printing frequencies using the drive waveform 1. The drive waveform 2 is used when there is no immediately preceding dot in printing using the drive waveform 1 at frequencies from 5 to 8.5 kHz.

More specifically, when printing is performed at frequencies from 5 to 8.5 kHz and print commands for successive dots are present, the drive waveform 1 is used to eject ink droplets. When a dot print command is intermittently present, the drive waveform 2 is used to eject ink droplets. Each of the four ink droplets that form one dot individually and sequentially impinges against the recording medium 700. Therefore, a dot having a large diameter relative to the number of ink droplets may be obtained in printing, such as shown in FIG. 3(*b*).

A drive waveform is selected from the drive waveforms previously prepared, according to whether there is an ink ejection command for an immediately preceding dot. A drive voltage is applied to the electrodes according to the selected drive waveform. Each of the ejected ink droplets sequentially and individually impinges against the recording medium, to enlarge a print dot diameter, so that improvements in the print density is achieved, leading to a high print quality.

Figure 5:
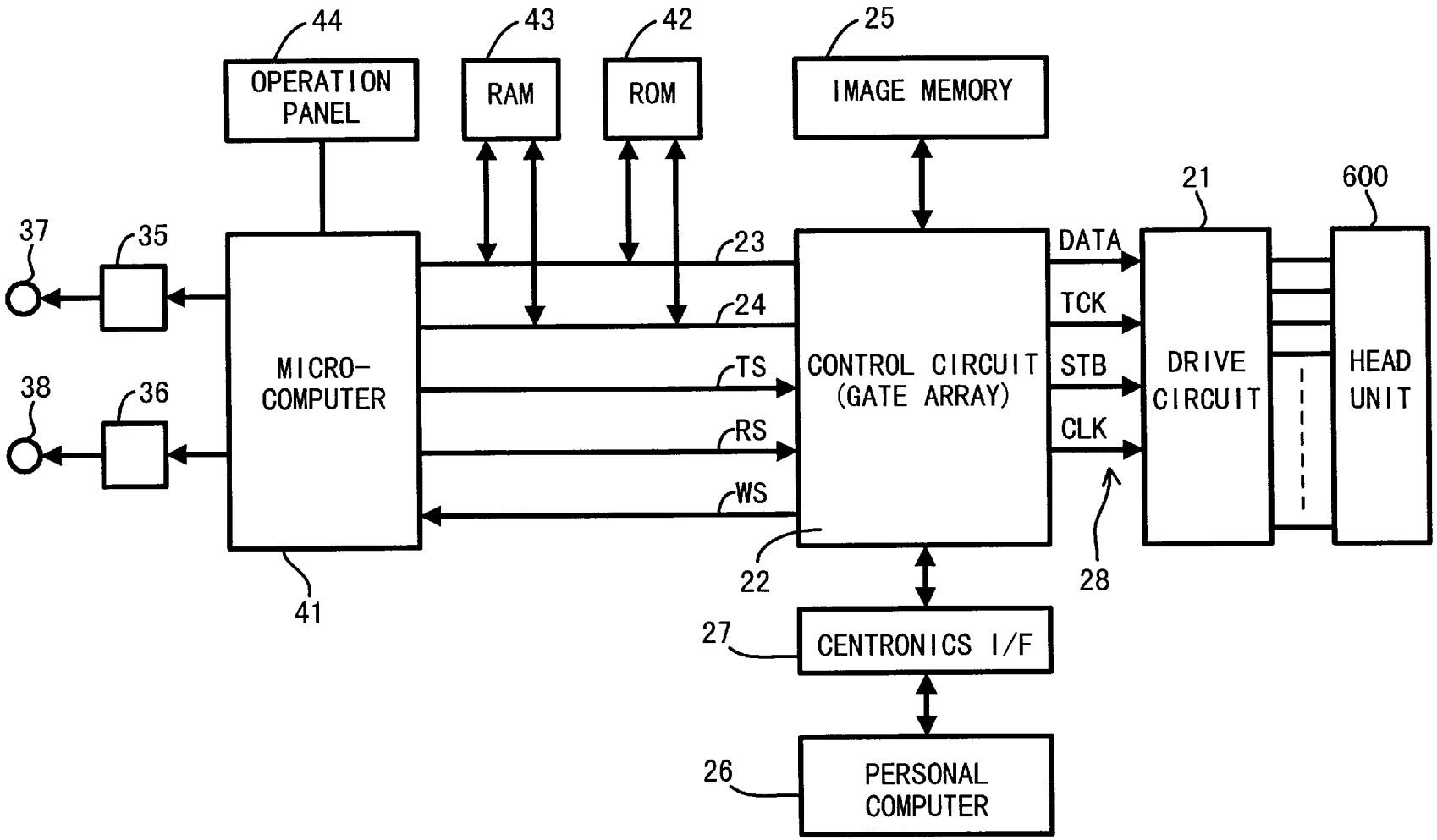
FIG. 5 is a block diagram showing hardware configuration of the ink-jet recording apparatus.

FIG. 5 is a block diagram showing the hardware configuration of the ink-jet recording apparatus. The ink-jet recording apparatus is provided with a single chip microcomputer 41, a ROM 42, and a RAM 43. Connected to the microcomputer 41 is an operation panel 44 operated by a user, a motor drive circuit 36 for driving a recording medium feed motor 38, and a motor drive circuit 35 for driving a carriage scanning motor 37.

The head unit 600 is driven by a drive circuit 21, which is controlled by a control circuit 22. Each electrode 621 disposed in each dummy channel 615 of the head unit 600 is connected to the drive circuit 21. The drive circuit 21 generates, under the control of the control circuit 22, various pulse signals and applies them to each electrode 621.

The microcomputer 41, the ROM 42, the RAM 43, and the control circuit 22 are interconnected via an address bus 23 and a data bus 24. The microcomputer 41 generates a print timing signal TS and a control signal RS using a program previously stored in the ROM 42, and transmits the signals TS, RS to the control circuit 22.

The control circuit 22, formed by a gate array, generates, based on image data stored in an image memory 25, print data DATA, and a transmission clock TCK, a strobe signal STB, and a print clock CLK, which are synchronous with the print data DATA, and transmits these signals to the drive circuit 21. The control circuit 22 stores in the image memory 25 the image data transmitted from a personal computer 26 via a Centronics interface 27. Further, the drive circuit 21 generates a Centronics data receiving interrupt signal WS and transmits it to the microcomputer 41, based on Centronics data transmitted from the personal computer 26 via the Centronics interface 27. The signals DATA, TCK, STB, and CLK are transmitted from the control circuit 22 to the drive circuit 21 via a wire harness 28.

Figure 6:
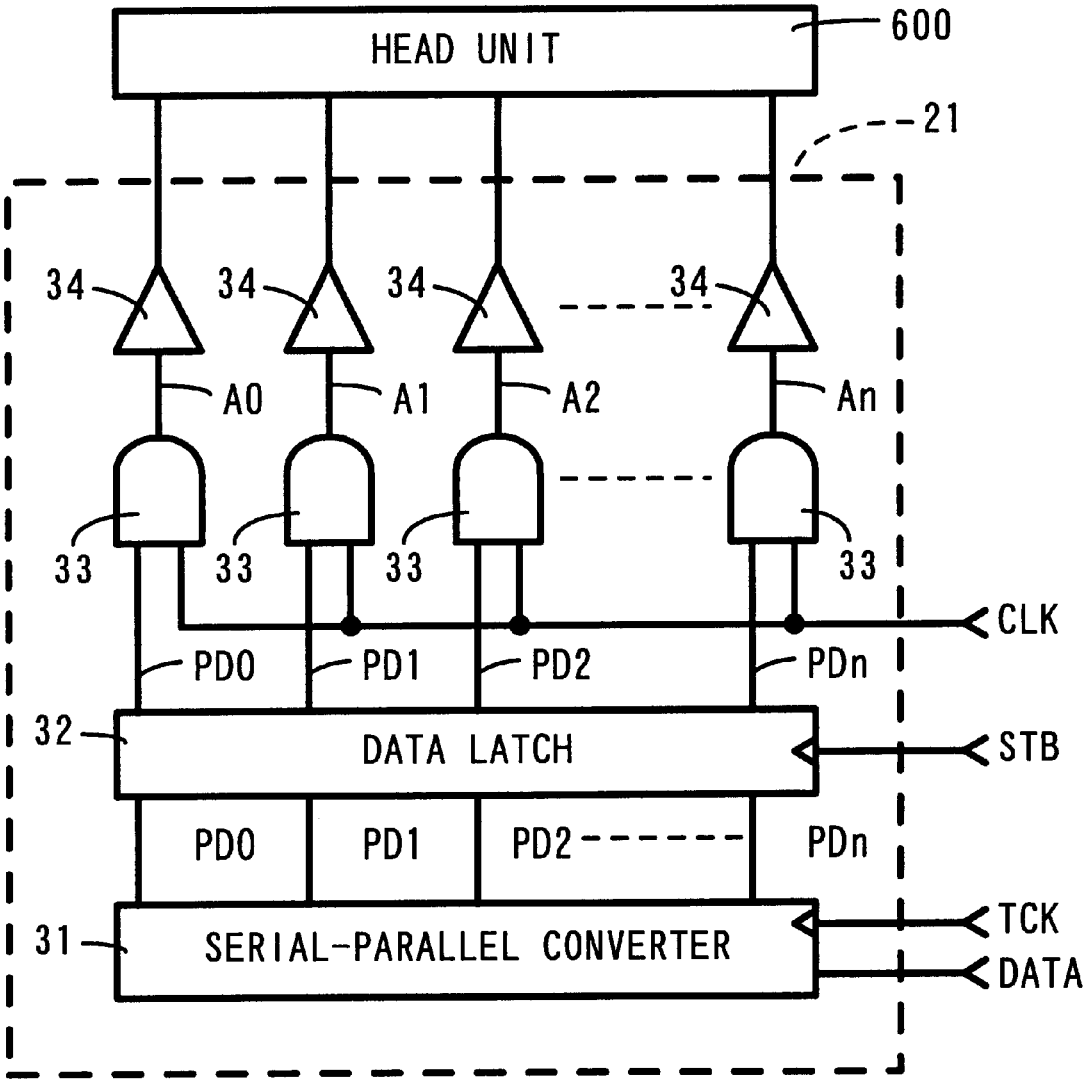
FIG. 6 is a detailed diagram of a drive circuit shown in FIG. 5.

FIG. 6 shows the internal configuration of the drive circuit 21. The drive circuit 21 is provided with a serial-parallel converter 31, a data latch 32, AND gates 33, and output circuits 34. The serial-parallel converter 31 is formed by a shift register for as many bits as the number of ink channels 613. The serial-parallel converter 31 receives the print data DATA from the control circuit 22, as serial data, which is transmitted in synchronism with the transmission clock TCK. The serial-parallel converter 31 converts the print data DATA to pieces of parallel data PD0-PDn. In this case, the number of ink channels 613 is n+1. The data latch 32 latches each piece of the parallel data PD0-PDn upon the rise of the strobe signal STB transmitted from the control circuit 22. Each AND gate 33 performs a logical multiplication of each piece of the parallel data PD0-PDn outputted from the data latch 32 and the print clock CLK transmitted from the control circuit 22, and generates drive data A0-An. Each output circuit 34 generates a signal to drive the electrode 621 of each dummy channel 615, as described below, based on an ON signal (+5 V) or an OFF signal (0 V) indicated by the drive data A0-An. The drive signal outputted from each output circuit 34 has the drive waveform 1 shown in FIG. 1(*a*) or the drive waveform 2 shown in FIG. 1(*b*).

Figure 7:
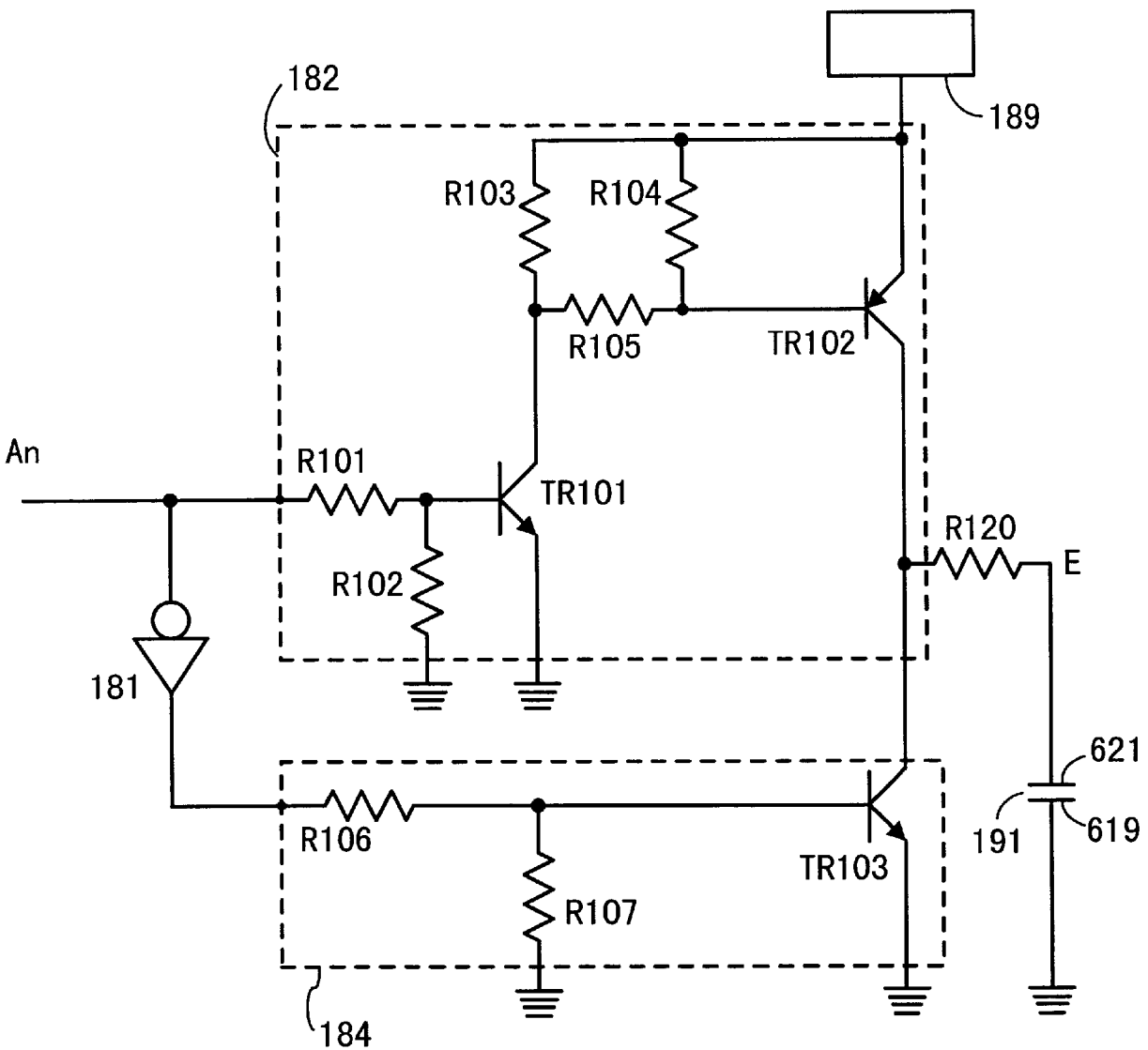
FIG. 7 is a detailed diagram of an output circuit shown in FIG. 6.

As shown in FIG. 7, each output circuit 34 includes a charge circuit 182 and a discharge circuit 184. The sidewall 617 made of piezoelectric material and the electrodes 619 and 621 are equivalent to a capacitor 191 and electrodes 619, 621.

The charge circuit 182 includes resistors R101-R105 and transistors TR101, TR102. When an ON signal (+5 V) is inputted as the drive data An to the charge circuit 182, the transistor TR101 is brought into conduction via the resistor R101, and a current flows from a positive power source 189, via the resistor R103, to a collector and then to an emitter of the transistor TR101. Thus, partial pressure applied to the transistors R104, R105, which are connected to the positive power source 189, increases, and a larger current flows into a base of the transistor TR102. Then, a collector and an emitter of the transistor TR102 are brought into conduction. A voltage of 20 V from the positive power source 189 is applied to the dummy channel electrode 621, via the collector and the emitter of the transistor TR102, and a resistor R120. Consequently, the corresponding sidewall 617 is deformed, as shown in FIG. 10, to increase the volmetric capacity of the ink channel 613. Time periods during which the ON signals are inputted to the charge circuit 182 correspond to widths of the ejection pulses F1–F8 and widths of the stabilizing pulses S1–S4 of the drive waveforms 1 and 2.

The discharge circuit 184 includes resistors R106, R107 and a transistor TR103. The drive data An is inputted to the discharge circuit 184, via an inverter 181. When the drive data An is changed from +5 V to 0 V, the inverter 181 outputs an inverted signal of +5 V. The inverted signal is inputted to a base of the transistor TR103, via the resistor R106. Consequently, the transistor TR103 is brought into conduction, and the electrode 619 is grounded, via the resistor R120. Thus, a charge applied to the sidewall 617 is discharged, and the ink channel 613 returns to its original state, as shown in FIG. 10. In this way, an increase and then a decrease in the volumetric capacity of the ink channel 613 pressurizes the ink in the ink channel 613 and causes ink ejection from the nozzle 618.

Figure 8:
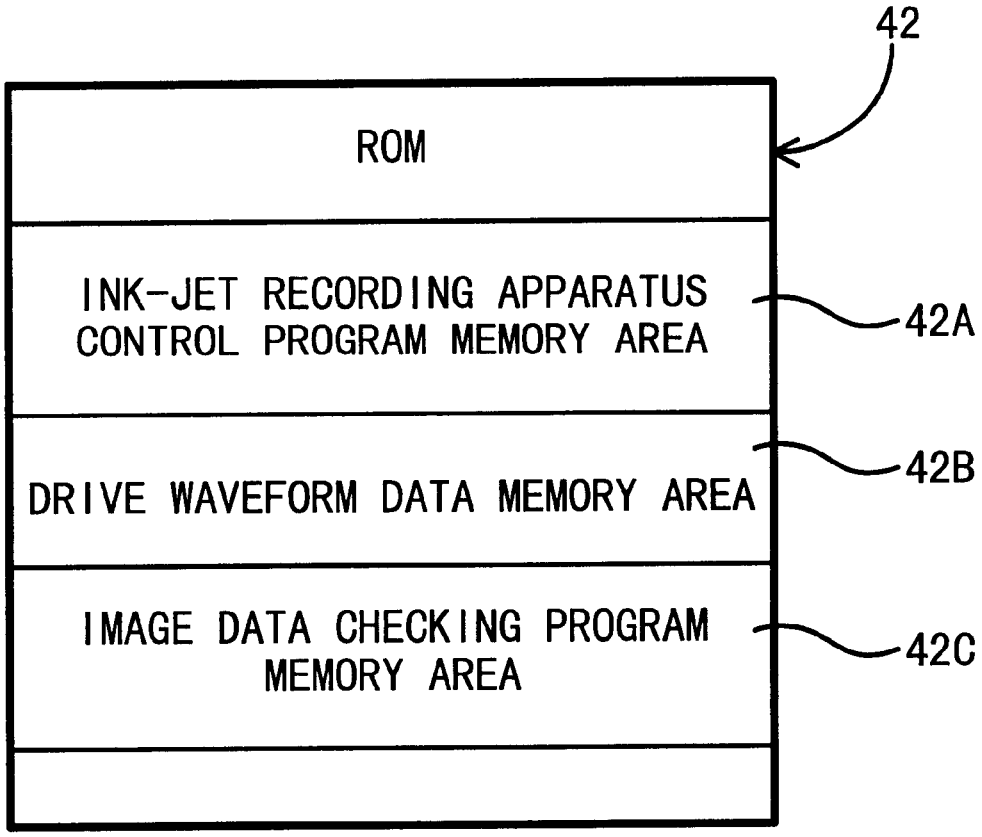
FIG. 8 is a diagram illustrating memory areas of a ROM shown in FIG. 5.

As shown in FIG. 8, the ROM 42 has a memory area 42A that stores a program for controlling the ink-jet recording apparatus, a memory area 42B that stores sequence data for generating the drive waveforms 1 and 2, and a memory area 42C that stores a program for checking the image data to determine whether a dot is printed immediately before a dot to be printed. The control circuit 22 generates the print clock CLK of a certain frequency. In accordance with the print clock CLK timing, the control circuit 22 outputs to the drive circuit 21 the print data DATA generated based on the image data stored in the image memory 25. The print data DATA is output to the drive circuit 21 as a binary signal corresponding to the drive waveform 1 or 2 stored in the memory area 42B of the ROM42.

Stored in the memory area 42C of the ROM 42 is a program for selecting the drive waveform, such as shown in FIG. 2(*b*), according to whether there is ink ejection for an immediately preceding dot. According to the program, the control circuit 22 checks the image data stored in the image memory 25, to determine whether a dot is printed immediately before a dot to be printed. When it is determined that a dot is printed immediately before a dot to be printed, that is, dots are to be successively printed, the drive waveform 1 is selected. Accordingly, the ink droplets are ejected using the drive waveform 1. When it is determined that a dot is not printed immediately before a dot to be printed, that is, dots are to be intermittently printed, the drive waveform 2 is selected. Accordingly, the ink droplets are ejected using the waveform 2.

A driver software for controlling the ink-jet recording apparatus installed in the personal computer 26 may check the image data to determine whether a dot is printed immediately before a dot to be printed. Based on the determination results, the drive waveform 1 or 2 may be selected.

Signals corresponding to the selected drive waveform 1 or 2 may be output to the control circuit 22 of the ink-jet recording apparatus.

The driver software may include data regarding the widths of the ejection pulses and the stabilizing pulses, intervals between the ejection pulses, and intervals between the ejection pulse and the stabilizing pulses of the drive waveforms, a program for checking the image data to determine if a dot is not printed immediately before a dot to be printed, and programs for selecting a drive waveform based on the determination results and outputting signals corresponding to a selected drive waveform. The driver software may be provided by a memory medium, such as a CD-ROM.

While the invention has been described with reference to the exemplary embodiment, it is to be understood that the invention is not restricted to the particular forms shown in the foregoing exemplary embodiment. Various modifications and alterations can be made thereto without departing from the scope of the invention.

For example, the widths, time intervals, number, and combination of the ejection pulses and the stabilizing pulses of a drive waveform may be arranged without restraint, according to the required resolutions.

In the above-described exemplary embodiment, a shear mode actuator is employed. However, another structure for generating a pressure wave, for example, by distortion of laminated piezoelectric material members in the laminating direction may be used. Materials other than piezoelectric material may be used if they generate a pressure wave in the ink channel.

What is claimed is:

1. An ink-jet recording apparatus, comprising:

an ink-jet head including:

a nozzle that ejects ink therefrom; and an actuator that defines an ink channel for filling the ink therein in communication with the nozzle;

a driving device that drives the actuator to form a dot according to a predetermined signal; and a controller that controls outputs of the signal to the driving device, the controller generating the signal based on a drive waveform determined according to a presence or an absence of a dot immediately before the dot to be formed.

2. The ink-jet recording apparatus according to claim 1, wherein the drive waveform includes a first drive waveform and a second drive waveform different from the first drive waveform and the controller selects either the first drive waveform or the second drive waveform and generates the signal based on the first drive waveform or the second drive waveform that is selected.

3. The ink-jet recording apparatus according to claim 2, wherein the first drive waveform and the second drive waveform are shaped to form the dot with a plurality of ink droplets.

4. The ink-jet recording apparatus according to claim 3, further comprising a memory that stores the first drive waveform and the second drive waveform.

5. The ink-jet recording apparatus according to claim 4, wherein the controller generates the signal based on the first drive waveform when a printing frequency is a first frequency and generates the signal based on the second drive waveform when the printing frequency is a second frequency.

6. The ink-jet recording apparatus according to claim 5, wherein the second frequency is half of the first frequency or lower.

7. The ink-jet recording apparatus according to claim 3, wherein each of the first drive waveform and the second drive waveform includes a same number of ejection pulses as a number of the ink droplets to be ejected to form the dot.

8. The ink-jet recording apparatus according to claim 7, wherein each of the first drive waveform and the second drive waveform includes a first ejection pulse to a nth ejection pulse, and at least one of the first ejection pulse to the nth ejection pulse of the first drive waveform is different from at least one corresponding ejection pulse of the first ejection pulse to the nth ejection pulses of the second drive waveform, with respect to a width thereof.

9. The ink-jet recording apparatus according to claim 7, wherein each of the first drive waveform and the second drive waveform includes a first ejection pulse to a nth ejection pulse, and at least one interval between one of the first ejection pulse to the nth ejection pulse and next one thereof in the first drive waveform is different from at least one corresponding interval between one of the first ejection pulse to the nth ejection pulse and next one thereof.

10. The ink-jet recording apparatus according to claim 7, wherein each of the first drive waveform and the second drive waveform includes a stabilizing pulse for reducing a vibration in the ink generated by the ejection pulses.

11. A method for ejecting ink from an ink-jet head with a nozzle that ejects ink therefrom and an actuator that defines an ink channel for filling the ink therein in communication with the nozzle, the method comprising the steps of:

driving the actuator to form a dot according to a predetermined signal; and controlling the output of the signal to the actuator such that the signal is generated based on a drive waveform determined according to a presence or an absence of a dot immediately before the dot to be formed.

12. The method according to claim 11, wherein the drive waveform includes a first drive waveform and a second drive waveform different from the first drive waveform, and the output of the signal to the actuator is controlled by either selecting the first drive waveform or the second drive waveform and generating the signal based on the first drive waveform or the second drive waveform that is selected.

13. The method according to claim 12, wherein the first drive waveform and the second drive waveform are shaped to form the dot with the plurality of ink droplets.

14. The method according to claim 13, further comprising the step of storing the first drive waveform and the second drive waveform.

15. The method according to claim 14, wherein the output of the signal to the actuator is based on the first drive waveform when a printing frequency is a first frequency and is based on the second drive waveform when the printing frequency is a second frequency.

16. The method according to claim 15, wherein the second frequency is half of the first frequency or lower.

17. The method according to claim 13, wherein each of the first drive waveform and the second drive waveform includes a same number of ejection pulses as a number of the ink droplets to be ejected to form the dot.

18. The method according to claim 17, wherein each of the first drive waveform and second drive waveform includes a first ejection pulse to an nth ejection pulse, and at least one of the first ejection pulse to the nth ejection pulse of the first drive waveform is different from at least one corresponding ejection pulse of the first ejection pulse to the nth ejection pulse of the second drive waveform with respect to a width thereof.

19. The method according to claim 17, wherein each of the first drive waveform and the second drive waveform includes a first ejection pulse to an nth ejection pulse, and an at least one interval between one of the first ejection pulse to an nth ejection pulse and next one thereof in the first drive waveform is different from at least one corresponding interval between one of the first ejection pulse to the nth ejection pulse and the next one thereof.

20. The method according to claim 17, wherein each of the first drive waveform and second drive waveform includes a stabilizing pulse for reducing a vibration in the ink generated by the ejection pulses.

21. A computer-readable medium storing a program for driving an ink jet head with the nozzle and an actuator to form a dot according to a predetermined signal, the program comprising:

a program for outputting the signal to the actuator;

a program for determining the presence or an absence of a dot immediately before the dot to be formed;

a program for generating the signal based on a drive waveform determined according to a presence or an absence of the dot immediately before the dot to be formed.

22. The program according to claim 21, wherein the drive waveform includes a first drive waveform and a second drive waveform different from the first waveform, wherein the signal is generated from either the first waveform or the second waveform.

23. The program according to claim 22, wherein the first drive waveform and second drive waveform are shaped to form the dot with a plurality of ink droplets.

24. The program according to claim 23, further comprising a program for storing the first drive waveform and the second drive waveform.

25. The program according to claim 24, wherein the program for generating the signal generates the signal based on the first drive waveform when a printing frequency is a first frequency or the second drive waveform when the printing frequency is a second frequency.

26. The program according to claim 25, wherein the second frequency is half of the first frequency or lower.

27. The program according to claim 23, wherein each of the first drive waveform and second drive waveform includes the same number of ejection pulses as a number of the ink droplets to be ejected to form the dot.

28. The program according to claim 27, wherein each of the first drive waveform and second drive waveform includes a first ejection pulse to an nth ejection pulse, and at least one of the first ejection pulse to the nth ejection pulses of the first drive waveform is different from at least one corresponding ejection pulse of the first ejection pulse to the nth ejection pulse of the second drive waveform, with respect to a width thereof.

29. The program according to claim 27, wherein each of the first drive waveform and the second drive waveform includes a first ejection pulse to an nth ejection pulse, and at least one interval between one of the first ejection pulse to the nth ejection pulse and next one thereof in the first drive waveform is different from at least one corresponding interval between one of the first ejection pulse to the nth ejection pulse and next one thereof in the second drive waveform.

30. The program according to claim 27, wherein each of the first drive waveform and the second drive waveform includes a stabilizing pulse for reducing a vibration and ink generated by the ejection pulses.

* * * * *

UNITED STATES PATENT AND TRADEMARK OFFICE

CERTIFICATE OF CORRECTION

PATENT NO. : 6,386,665 B2
DATED : May 14, 2002
INVENTOR(S) : Yoshikazu Takahashi et al.

It is certified that error appears in the above-identified patent and that said Letters Patent is hereby corrected as shown below:

Title page,
Item [63], correct to read as follows:

-- [63] Continuation-in-part of application No. 09/200,986, filed on Nov. 30, 1998, now Pat. No. 6,257,686, application No. 09/841,830, filed on Apr. 26, 2001, now Pat. No. 6,412,896, and application No. 09/841,997, filed on Apr. 26, 2001, now Pat. No. 6,416,149 --.

Signed and Sealed this

Twelfth Day of November, 2002

*Attest:*

*Attesting Officer*

JAMES E. ROGAN
*Director of the United States Patent and Trademark Office*